US010044087B2

(12) United States Patent
Huang Chen et al.

(10) Patent No.: US 10,044,087 B2
(45) Date of Patent: Aug. 7, 2018

(54) SWITCHABLE RADIATORS AND OPERATING METHOD FOR THE SAME

(71) Applicant: MICROELECTRONICS TECHNOLOGY, INC., Hsinchu (TW)

(72) Inventors: Wei Huang Chen, Hsinchu County (TW); Chang-Chun Chen, Hsinchu (TW); Chia-Yu Chou, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 26 days.

(21) Appl. No.: 15/293,732

(22) Filed: Oct. 14, 2016

(65) Prior Publication Data

US 2018/0108970 A1 Apr. 19, 2018

(51) Int. Cl.
*H01P 3/16* (2006.01)
*H01P 3/12* (2006.01)

(52) U.S. Cl.
CPC . *H01P 3/16* (2013.01); *H01P 3/12* (2013.01)

(58) Field of Classification Search
CPC .. H01J 23/24; H01P 1/182; H01P 3/12; H01P 3/16; H03H 7/20; H01Q 9/145; H01Q 9/26
USPC ..... 333/157, 164, 239, 250; 343/745, 803, 343/806, 700 MS
See application file for complete search history.

(56) References Cited

U.S. PATENT DOCUMENTS 6,333,719 B1 12/2001 Varadan et al.
6,377,440 B1 4/2002 Zhu et al.
6,727,535 B1 * 4/2004 Sengupta ..... H01G 7/06 257/295
6,756,939 B2 6/2004 Chen et al.
6,756,947 B2 6/2004 Toncich et al.
6,864,840 B2 3/2005 Zhu et al.
6,972,727 B1 * 12/2005 West ..... H01P 1/181 333/157
7,109,818 B2 * 9/2006 Rivkina ..... H01P 1/181 257/295

(Continued)

FOREIGN PATENT DOCUMENTS

WO WO0035042 6/2000

OTHER PUBLICATIONS

Office Action dated Feb. 14, 2018 from the Taiwan counterpart application 105141577.

*Primary Examiner* — Dean Takaoka
(74) *Attorney, Agent, or Firm* — WPAT, P.C., Intellectual Property Attorneys; Anthony King

(57) ABSTRACT

A switchable radiator includes a dielectric substrate, a first conductive layer having a slot disposed over an upper surface of the dielectric substrate, a tunable dielectric layer disposed over the first conductive layer, and a second conductive layer disposed over the tunable dielectric layer. The tunable dielectric layer has a first dielectric constant at a first DC voltage and a second dielectric constant at a second DC voltage. The second conductive layer includes a first signal section, a second signal section, and an impedance-matching section connecting the first signal section and the second signal section. The operation method of the switchable radiator includes applying a first DC voltage to the tunable dielectric layer to enable the switchable radiator to radiate energy through the slot and applying a second DC voltage to the tunable dielectric layer to disable the switchable radiator from radiating energy through the slot.

19 Claims, 7 Drawing Sheets

(56) References Cited

U.S. PATENT DOCUMENTS

| | | | | |
|---|---|---|---|---|
| 7,375,694 | B2 * | 5/2008 | Jung | H01Q 1/243<br>343/700 MS |
| 8,648,676 | B2 * | 2/2014 | Abhari | H01P 1/184<br>333/209 |
| 9,000,866 | B2 * | 4/2015 | Subramanyam | H01P 1/15<br>257/601 |
| 2006/0152304 | A1 * | 7/2006 | Liang | H01P 1/2039<br>333/176 |
| 2010/0096678 | A1 * | 4/2010 | Subramanyam | H01P 1/10<br>257/295 |

* cited by examiner

SWITCHABLE RADIATORS AND OPERATING METHOD FOR THE SAME

TECHNICAL FIELD

The present disclosure relates to switchable radiators and an operating method for the same, and more particularly to switchable radiators containing tunable dielectrics for transmitting signals and an operating method for the same.

DISCUSSION OF THE BACKGROUND

With the development of the communication industry in recent years, various communication products have been developed for different applications, and antenna designs adaptable to industrial standards are in a great demand. In addition, in many known microwave and radio frequency transceiver devices, it is necessary to transfer signals from one side of a multilayer circuit board to another side, and it would be desirable to make the transfer with a minimum loss in power. Traditionally, the transfer is accomplished by use of microstrip transmission lines.

Stripline slot antennas are well known in the art. These antennas are generally formed by etching a radiating aperture (slot) on one ground plane of a stripline sandwich circuit. The stripline sandwich comprises a conducting strip, and a transmission line insulatively disposed between two ground planes. Energy is coupled to the slot over the transmission line with the electric fields propagated thereon confined within the dielectric boundaries between the ground planes.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY

One aspect of the present disclosure provides a switchable radiator containing tunable dielectrics for transmitting signals and an operating method for the same.

In some embodiments of the present disclosure, a switchable radiator comprises a dielectric substrate; a first conductive layer having a slot disposed over an upper surface of the dielectric substrate; a tunable dielectric layer disposed over the first conductive layer, wherein the tunable dielectric layer has a first dielectric constant at a first DC voltage and a second dielectric constant at a second DC voltage; and a second conductive layer disposed over the tunable dielectric layer, wherein the second conductive layer comprises a first signal section, a second signal section, and an impedance-matching section connecting the first signal section and the second signal section.

In some embodiments of the present disclosure, a switchable radiator comprises a waveguide structure including a conductive shell having a slot in an upper metal of the conductive shell; a tunable dielectric layer disposed over the upper metal, wherein the tunable dielectric layer has a first dielectric constant at a first DC voltage and a second dielectric constant at a second DC voltage; and a conductive layer disposed over the tunable dielectric layer; wherein the conductive shell forms an inductive loading, and the tunable dielectric layer and the conductive layer form a capacitive loading.

In some embodiments of the present disclosure, the switchable radiator further comprises a bottom conductive layer disposed on a bottom surface of the dielectric substrate.

In some embodiments of the present disclosure, the switchable radiator further comprises a voltage-applying device configured to apply a DC voltage to the tunable dielectric layer so as to control the dielectric constant of the tunable dielectric layer.

In some embodiments of the present disclosure, the voltage-applying device is configured to apply the DC voltage to the tunable dielectric layer through the first conductive layer and the second conductive layer.

In some embodiments of the present disclosure, the first signal section and the second signal section have an effective electrical length substantially equal to an odd integral number of quarter wavelengths at an operating frequency, and the switchable radiator is substantially at a turn-off state at the operating frequency.

In some embodiments of the present disclosure, the slot exposes the upper surface of the dielectric substrate, and the tunable dielectric layer covers the slot.

In some embodiments of the present disclosure, the slot is a U-shaped slot substantially separating the first conductive layer into a first-sub metal portion and a second-sub metal portion, the first signal section is above the first-sub metal portion, the second signal section is above the second-sub metal portion, and the impedance-matching section is above the U-shaped slot.

In some embodiments of the present disclosure, the voltage-applying device is configured to apply the DC voltage to the tunable dielectric layer through the upper metal and the conductive layer.

In some embodiments of the present disclosure, the slot is an I-shaped slot and the conductive layer is an H-shaped conductor In some embodiments of the present disclosure, the conductive shell surrounds a waveguide cavity, the slot exposes the waveguide cavity, and the tunable dielectric layer covers the slot.

In some embodiments of the present disclosure, a switchable radiator comprises a first conductive layer having a slot, a second conductive layer, and a tunable dielectric layer between the first conductive layer and the second conductive layer; and an operating method of the switchable radiator comprises changing an applied DC voltage to the tunable dielectric layer so as to alter a radiation property of the switchable radiator.

In some embodiments of the present disclosure, a switchable radiator comprises a waveguide structure including a conductive shell having a slot, a conductive layer, and a tunable dielectric layer between the conductive shell and the conductive layer, wherein the conductive shell forms an inductive loading, and the tunable dielectric layer and the conductive layer form a capacitive loading; and an operating method of the switchable radiator comprises changing an applied DC voltage to the tunable dielectric layer so as to alter a radiation property of the switchable radiator.

In some embodiments of the present disclosure, changing an applied DC voltage to the tunable dielectric layer is performed through the first conductive layer and the second conductive layer.

In some embodiments of the present disclosure, changing an applied DC voltage to the tunable dielectric layer is performed through the conductive shell and the conductive layer.

In some embodiments of the present disclosure, changing an applied DC voltage to the tunable dielectric layer alters a dielectric constant of the tunable dielectric layer.

In some embodiments of the present disclosure, the operating method comprises applying a first DC voltage to the tunable dielectric layer so as to enable the switchable radiator to radiate energy through the slot, and applying a second DC voltage to the tunable dielectric layer so as to disable the switchable radiator from radiating energy through the slot In some embodiments of the present disclosure, the inductive loading and the capacitive loading form a radiating structure, where the operating method comprises applying a first DC voltage to the tunable dielectric layer so as to disable the switchable radiator from radiating energy through the radiating structure and applying a second DC voltage to the tunable dielectric layer so as to enable the switchable radiator to radiate energy through the radiating structure.

The foregoing has outlined rather broadly the features and technical advantages of the present disclosure in order that the detailed description of the disclosure that follows may be better understood. Additional features and advantages of the disclosure will be described hereinafter, which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The present disclosure is directed to switchable radiators containing tunable dielectrics for transmitting signals and an operating method for the same. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
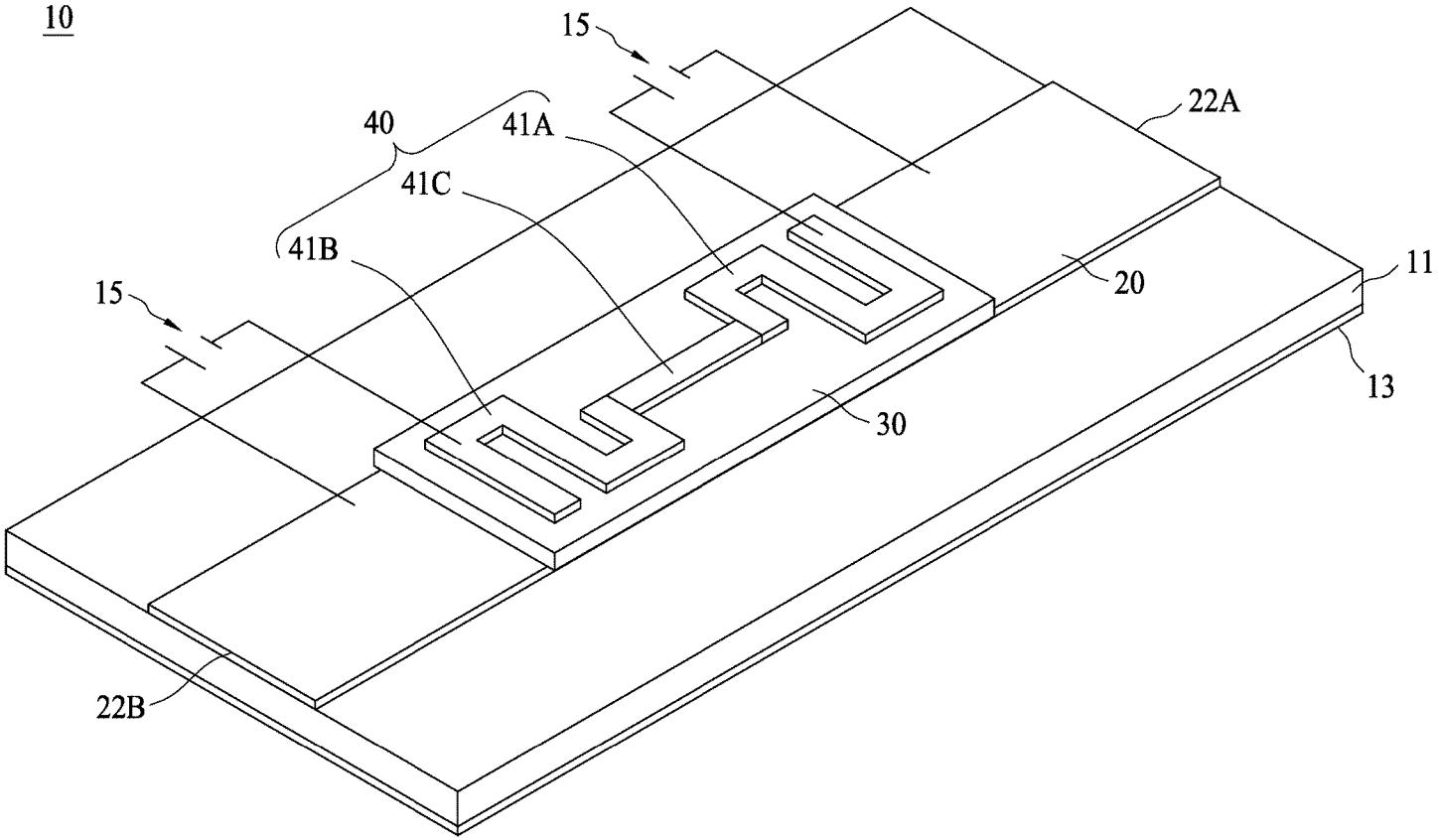
FIG. 1 illustrates a three-dimensional view of a switchable radiator according to some embodiments of the present disclosure.
Figure 2:
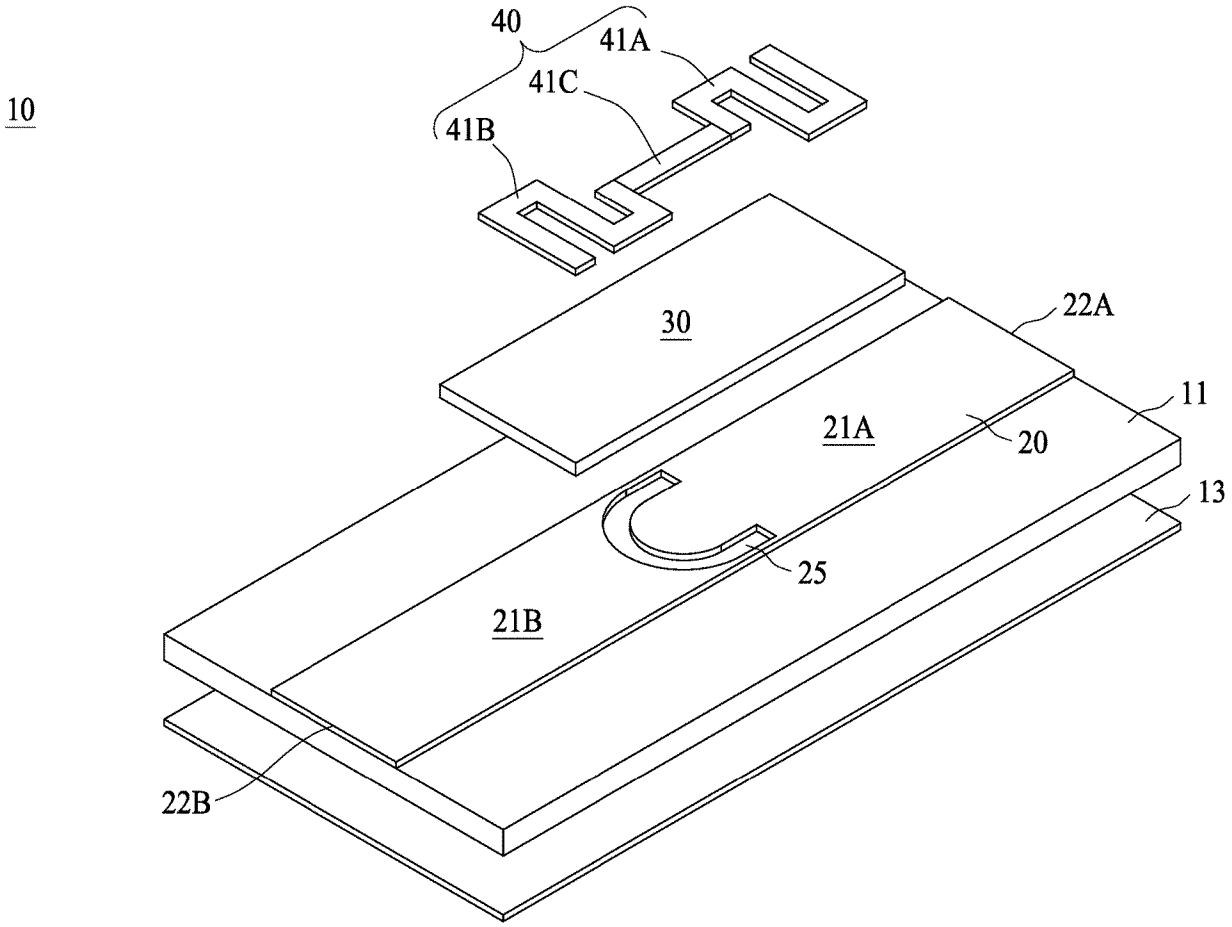
FIG. 2 illustrates a disassembled view of a switchable radiator according to some embodiments of the present disclosure.

FIG. 1 illustrates a three-dimensional view of a switchable radiator 10 according to some embodiments of the present disclosure and FIG. 2 illustrates a disassembled view of the switchable radiator 10 according to some embodiments of the present disclosure. In some embodiments of the present disclosure, the switchable radiator 10 comprises a dielectric substrate 11, a bottom conductive layer 13 disposed on a bottom surface of the dielectric substrate 11, a first conductive layer 20 disposed over an upper surface of the dielectric substrate 11, a tunable dielectric layer 30 disposed over the first conductive layer 20, and a second conductive layer 40 disposed over the tunable dielectric layer 30.

In some embodiments of the present disclosure, the dielectric substrate 11 is a fiberglass substrate, and the bottom conductive layer 13, the first conductive layer 20, and the second conductive layer 40 are made of conductors, such as copper. In some embodiments of the present disclosure, the bottom conductive layer 13 substantially covers the bottom surface of the dielectric substrate 11.

In some embodiments of the present disclosure, the first conductive layer 20 comprises a slot 25, such as a U-shaped slot, substantially separating the first conductive layer 20 into a first sub-metal portion 21A and a second-sub metal portion 21B. In some embodiments of the present disclosure, the second conductive layer 40 comprises a first signal section 41A, a second signal section 41B, and an impedance-matching section 41C connecting the first signal section 41A and the second signal section 41B. In some embodiments of the present disclosure, the first signal section 41A is above the first-sub metal portion 21A, the second signal section 41B is above the second-sub metal portion 21B, and the impedance-matching section 41C is above the U-shaped slot 25.

Figure 3:
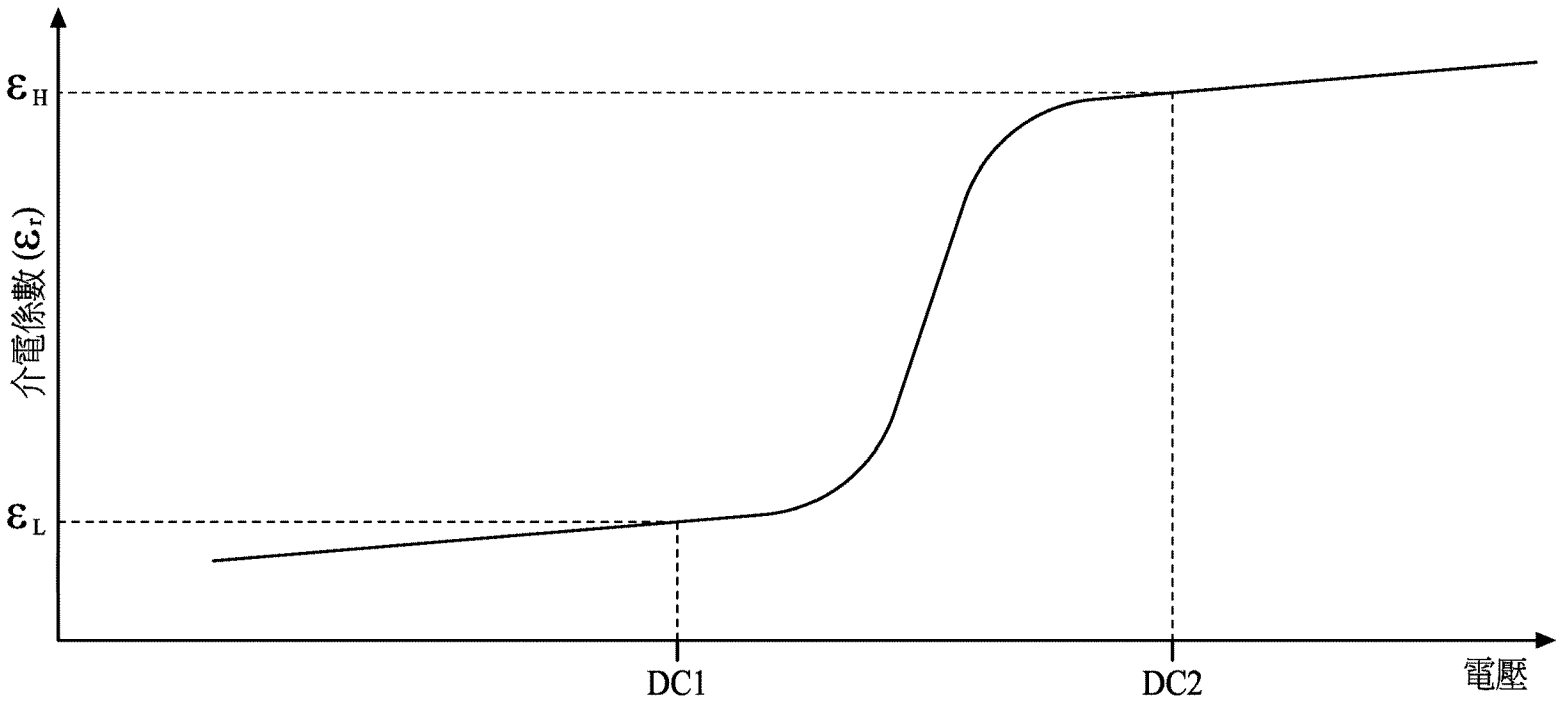
FIG. 3 illustrates a plot showing the variation of the dielectric constant of the tunable dielectric layer with respect to different DC voltages according to some embodiments of the present disclosure.

FIG. 3 illustrates a plot showing the variation of the dielectric constant of the tunable dielectric layer 30 with respect to different DC voltages according to some embodiments of the present disclosure. In some embodiments of the present disclosure, the tunable dielectric layer 30 is composed of liquid crystal, which has a first dielectric constant ($\varepsilon_L$) at a first DC voltage (DC1) and a second dielectric constant ($\varepsilon_H$) at a second DC voltage (DC2), wherein the first dielectric constant ($\varepsilon_L$) is lower than the second dielectric constant ($\varepsilon_H$). In other words, changing the applied DC voltage to the tunable dielectric layer 30 can alter the dielectric constant of the tunable dielectric layer 30.

Referring back to FIG. 1, in some embodiments of the present disclosure, the switchable radiator 10 further comprises a voltage-applying device 15 configured to apply a DC voltage to the tunable dielectric layer 30 so as to control the dielectric constant of the tunable dielectric layer 30. In some embodiments of the present disclosure, the voltage-applying device 15 is configured to apply the DC voltage to the tunable dielectric layer 30 through the first conductive layer 20 and the second conductive layer 40.

In some embodiments of the present disclosure, applying a second DC voltage (DC2) to the tunable dielectric layer 30, the tunable dielectric layer 30 and the second conductive layer 40 form a short circuit connecting the first sub-metal portion 21A and the second-sub metal portion 21B, the slot 25 is bypassed, and the switchable radiator 10 is disabled from radiating energy, and the switchable radiator 10 serves as a microstrip line for transmitting signals between two terminals 22A, 22B of the first conductive layer 20. When the switchable radiator 10 serves as a microstrip line for transmitting signals between two terminals 22A, 22B, the bottom conductive layer 13 functions as a ground plane.

In some embodiments of the present disclosure, the first signal section 41A and the second signal section 41B are implemented by conductive lines having an effective electrical length substantially equal to an odd integral number of quarter wavelengths at an operating frequency, and the impedance-matching section 41C is implemented by a conductive line connecting the first signal section 41A and the second signal section 41B. In some embodiments, the conductive line has an effective electrical length substantially equal to an odd integral number of quarter wavelengths at the operating frequency.

Figure 4:
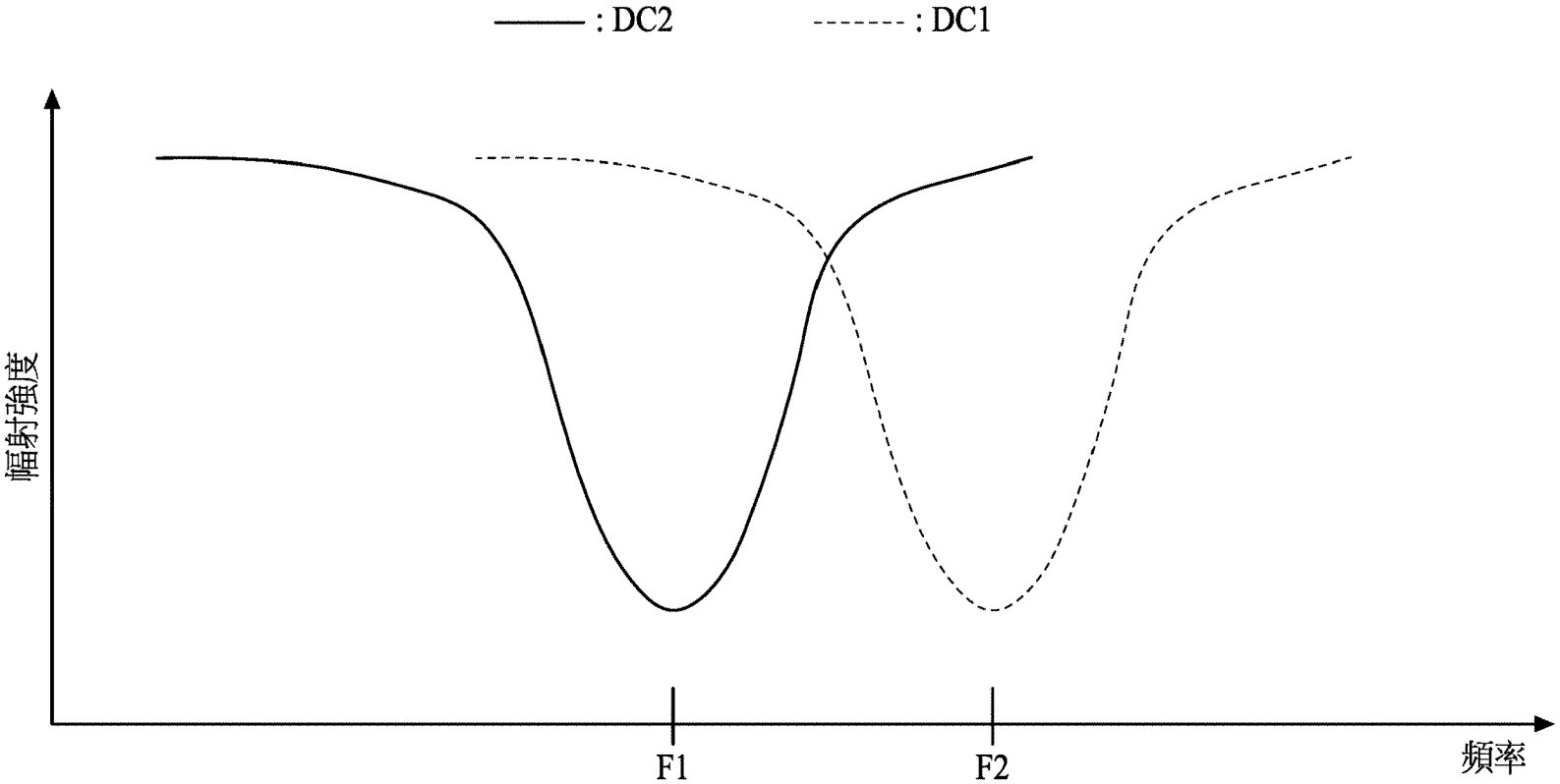
FIG. 4 is a plot showing the variation of the radiation property (radiation intensity or radiation power) of the switchable radiator with respect to the frequency under different voltages according to some embodiments of the present disclosure.

FIG. 4 is a plot showing the variation of the radiation property (radiation intensity or radiation power) of the switchable radiator 10 with respect to the frequency under different voltages according to some embodiments of the present disclosure. Assuming the switchable radiator 10 is designed to operate at the operating frequency (F1), the radiation property of the switchable radiator 10 is at a low level for the operating frequency since the tunable dielectric layer 30 is biased at the second DC voltage (DC2), i.e., the switchable radiator 10 is considered to be at the turn-off state and disabled from radiating energy through the slot 25. As the tunable dielectric layer 30 is biased at the first DC voltage (DC1), the radiation property of the switchable radiator 10 is at a relatively high level for the operating frequency, i.e., the switchable radiator 10 is considered to be at the turn-on state and enabled to radiate energy through the slot 25.

In other words, changing the applied DC voltage to the tunable dielectric layer 30 can alter the radiation property of the switchable radiator 10 for the operating frequency, i.e., applying the first DC voltage (DC1) to the tunable dielectric layer 30 so as to enable the switchable radiator 10 to radiate energy through the slot 25 and applying a second DC voltage (DC2) to the tunable dielectric layer 30 so as to disable the switchable radiator 10 from radiating energy through the slot 25.

In addition, as the biasing voltage of the tunable dielectric layer 30 is changed from the second DC voltage (DC2) to the first DC voltage (DC1), the waveform of the radiation property of the switchable radiator 10 shifts with respect to the frequency (i.e., shifting along the lateral axis) such that the radiation property of the switchable radiator 10 is at a relatively low level for another frequency (F2) but at a relatively high level for the operating frequency (F1).

Figure 5:
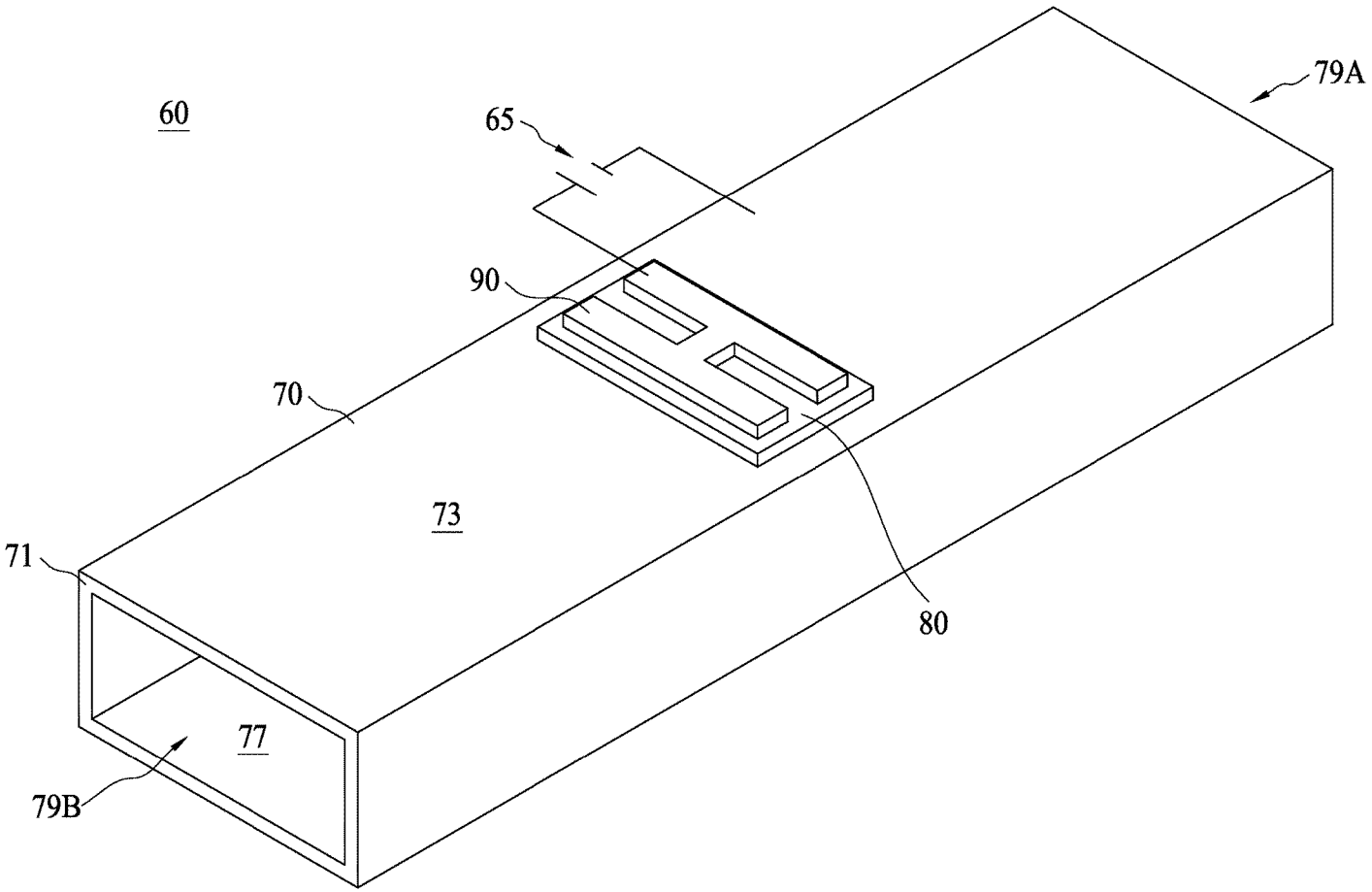
FIG. 5 illustrates a three-dimensional view of a switchable radiator according to some embodiments of the present disclosure.
Figure 6:
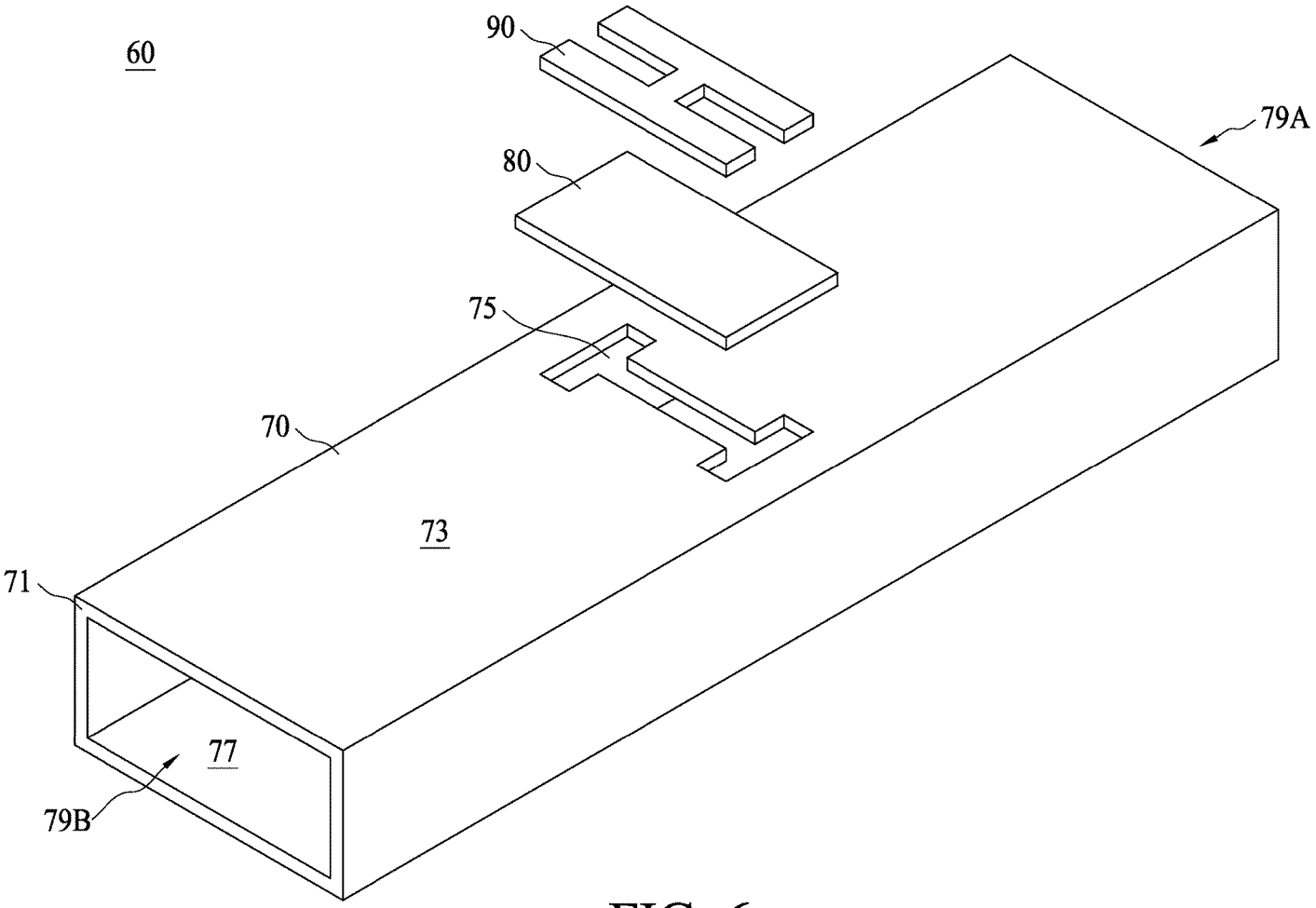
FIG. 6 illustrates a disassembled view of the switchable radiator according to some embodiments of the present disclosure.

FIG. 5 illustrates a three-dimensional view of a switchable radiator 60 according to some embodiments of the present disclosure and FIG. 6 illustrates a disassembled view of the switchable radiator 60 according to some embodiments of the present disclosure. In some embodiments of the present disclosure, the switchable radiator 60 comprises a waveguide structure 70 including a conductive shell 71 having a slot 75 in an upper metal 73 of the conductive shell 70; a tunable dielectric layer 80 disposed over the upper metal 73, and a conductive layer 90 disposed over the tunable dielectric layer 80.

In some embodiments of the present disclosure, the tunable dielectric layer 80 is similar to the tunable dielectric layer 30 having a first dielectric constant ($\varepsilon_L$) at a first DC voltage (DC1) and a second dielectric constant ($\varepsilon_H$) at a second DC voltage (DC2); in other words, changing an applied DC voltage to the tunable dielectric layer 80 alters a dielectric constant of the tunable dielectric layer 80. In some embodiments of the present disclosure, the conductive shell 71 forms an inductive loading, and the tunable dielectric layer 80 and the conductive layer 90 form a capacitive loading.

In some embodiments of the present disclosure, the switchable radiator 60 further comprises a voltage-applying device 65 configured to apply a DC voltage to the tunable dielectric layer 80 so as to control the dielectric constant of the tunable dielectric layer 80. In some embodiments of the present disclosure, the voltage-applying device 65 is configured to apply the DC voltage to the tunable dielectric layer 80 through the upper metal 73 and the conductive layer 90. In some embodiments of the present disclosure, the inductive loading and the capacitive loading form a radiating structure.

In some embodiments of the present disclosure, the slot 75 is an I-shaped slot and the conductive layer 90 is an H-shaped conductor. In some embodiments of the present disclosure, the conductive shell 71 surrounds a waveguide cavity 77 where the radio frequency energy propagates between two terminal 79A, 79B of the waveguide structure 70, the slot 75 exposes the waveguide cavity 77, and the tunable dielectric layer 80 covers the slot 75.

Figure 7:
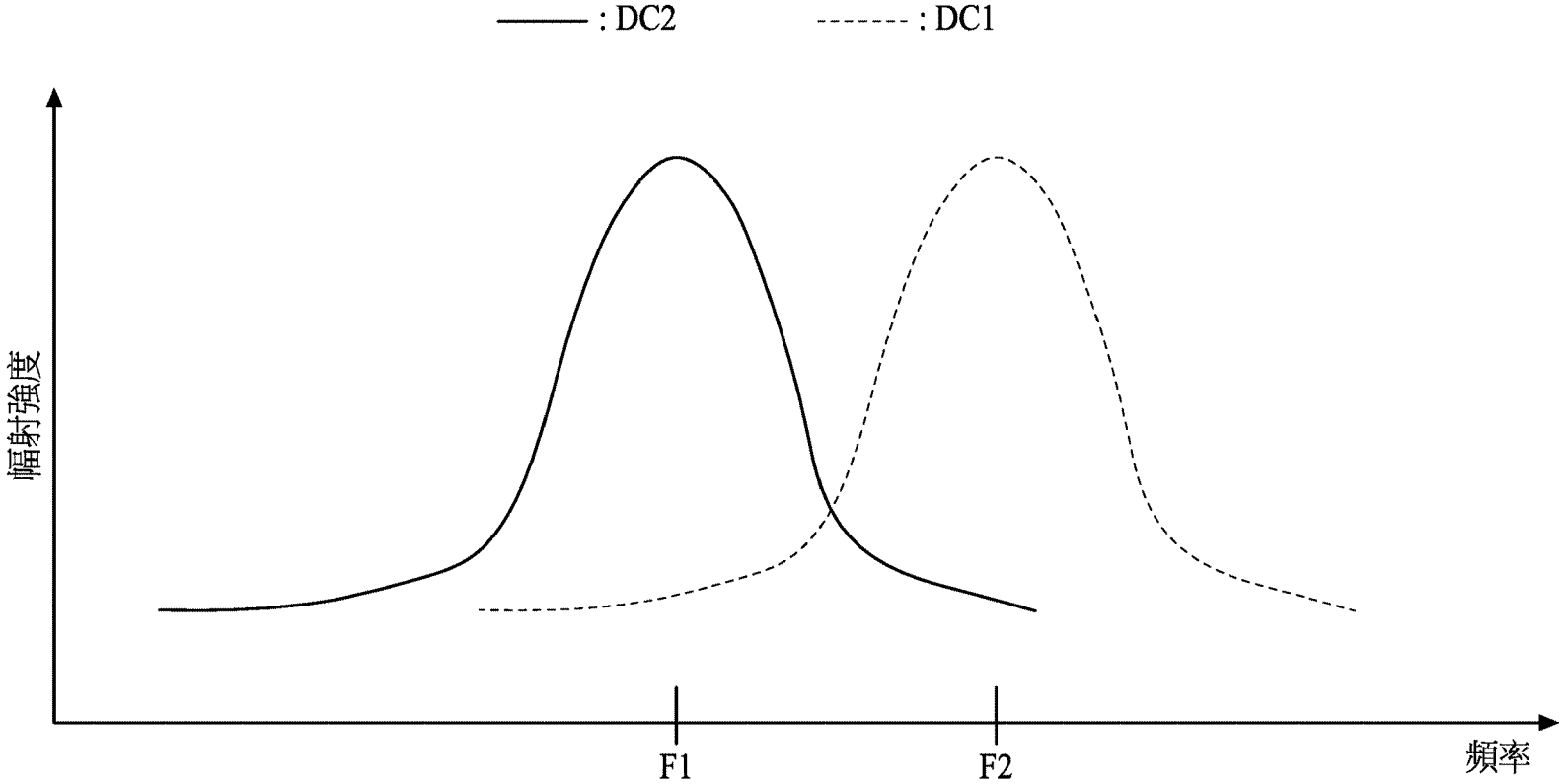
FIG. 7 illustrates a plot showing the variation of the radiation property (radiation intensity or radiation power) of the switchable radiator with respect to the frequency under different voltages according to some embodiments of the present disclosure.

FIG. 7 illustrates a plot showing the variation of the radiation property (radiation intensity or radiation power) of the switchable radiator 60 with respect to the frequency under different voltages according to some embodiments of the present disclosure. In some embodiments of the present disclosure, assuming the switchable radiator 60 is designed to operate at the operating frequency (F1), the radiation property of the switchable radiator 60 is at a high level for the operating frequency since the tunable dielectric layer 80 is biased at the second DC voltage (DC2), i.e., the switchable radiator 60 is at the turn-on state and enabled to radiate energy through the radiating structure. As the tunable dielectric layer 80 is biased at the first DC voltage (DC1), the radiation property of the switchable radiator 60 is at a relatively low level for the operating frequency, i.e., the switchable radiator 60 is at the turn-off state and the switchable radiator 10 is disabled from radiating energy through the radiating structure.

In other words, changing the applied DC voltage to the tunable dielectric layer 80 can alter the radiation property of the switchable radiator 60 for the operating frequency, i.e., applying the first DC voltage (DC1) to the tunable dielectric layer 80 disables the switchable radiator 60 from radiating energy through the radiating structure and applying a second DC voltage (DC2) to the tunable dielectric layer 80 enables the switchable radiator 60 to radiate energy through the radiating structure.

In addition, as the biasing voltage of the tunable dielectric layer 80 is changed from the second DC voltage (DC2) to the first DC voltage (DC1), the waveform of the radiation property of the switchable radiator 60 shifts along the lateral axis, such that the radiation property of the switchable radiator 60 is at a relatively low level for the operating frequency (F1) but at a relatively high level for another frequency (F2).

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A switchable radiator, comprising:

a dielectric substrate;

a first conductive layer having a slot disposed over an upper surface of the dielectric substrate;

a tunable dielectric layer disposed over the first conductive layer, wherein the tunable dielectric layer has a first dielectric constant at a first DC voltage and a second dielectric constant at a second DC voltage; and a second conductive layer disposed over the tunable dielectric layer, wherein the second conductive layer comprises a first signal section, a second signal section, and an impedance-matching section connecting the first signal section and the second signal section.

2. The switchable radiator of claim 1, further comprising a bottom conductive layer disposed on a bottom surface of the dielectric substrate.

3. The switchable radiator of claim 1, further comprising a voltage-applying device configured to apply a DC voltage to the tunable dielectric layer so as to control the dielectric constant of the tunable dielectric layer.

4. The switchable radiator of claim 3, wherein the voltage-applying device is configured to apply the DC voltage to the tunable dielectric layer through the first conductive layer and the second conductive layer.

5. The switchable radiator of claim 1, wherein the first signal section and the second signal section have an effective electrical length substantially equal to an odd integral number of quarter wavelengths at an operating frequency, and the switchable radiator is substantially at a turn-off state at the operating frequency.

6. The switchable radiator of claim 1, wherein the slot exposes the upper surface of the dielectric substrate, and the tunable dielectric layer covers the slot.

7. The switchable radiator of claim 1, wherein the slot is a U-shaped slot substantially separating the first conductive layer into a first-sub metal portion and a second-sub metal portion, the first signal section is above the first-sub metal portion, the second signal section is above the second-sub metal portion, and the impedance-matching section is above the U-shaped slot.

8. A switchable radiator, comprising:

a waveguide structure including a conductive shell having a slot in an upper metal of the conductive shell;

a tunable dielectric layer disposed over the upper metal, wherein the tunable dielectric layer has a first dielectric constant at a first DC voltage and a second dielectric constant at a second DC voltage; and a conductive layer disposed over the tunable dielectric layer;

wherein the conductive shell forms an inductive loading, and the tunable dielectric layer and the conductive layer form a capacitive loading.

9. The switchable radiator of claim 8, further comprising a voltage-applying device configured to apply a DC voltage to the tunable dielectric layer so as to control the dielectric constant of the tunable dielectric layer.

10. The switchable radiator of claim 9, wherein the voltage-applying device is configured to apply the DC voltage to the tunable dielectric layer through the upper metal and the conductive layer.

11. The switchable radiator of claim 8, wherein the slot is an I-shaped slot and the conductive layer is an H-shaped conductor.

12. The switchable radiator of claim 8, wherein the conductive shell surrounds a waveguide cavity, the slot exposes the waveguide cavity, and the tunable dielectric layer covers the slot.

13. An operating method of a switchable radiator comprising a first conductive layer having a slot, a second conductive layer, and a tunable dielectric layer between the first conductive layer and the second conductive layer; wherein the operating method comprises changing an applied DC voltage to the tunable dielectric layer so as to alter a radiation property of the switchable radiator;

wherein the operating method further comprises applying a first DC voltage to the tunable dielectric layer so as to enable the switchable radiator to radiate energy through the slot and applying a second DC voltage to the tunable dielectric layer so as to disable the switchable radiator from radiating energy through the slot.

14. The operating method of a switchable radiator of claim 13, wherein changing an applied DC voltage to the tunable dielectric layer is performed through the first conductive layer and the second conductive layer.

15. The operating method of a switchable radiator of claim 13, wherein changing an applied DC voltage to the tunable dielectric layer alters a dielectric constant of the tunable dielectric layer.

16. An operating method of a switchable radiator comprising a waveguide structure including a conductive shell having a slot, a conductive layer, and a tunable dielectric layer between the conductive shell and the conductive layer; wherein the conductive shell forms an inductive loading, and the tunable dielectric layer and the conductive layer form a capacitive loading; wherein the operating method comprises changing an applied DC voltage to the tunable dielectric layer so as to alter a radiation property of the switchable radiator.

17. The operating method of a switchable radiator of claim 16, wherein changing an applied DC voltage to the tunable dielectric layer is performed through the conductive shell and the conductive layer.

18. The operating method of a switchable radiator of claim 16, wherein changing an applied DC voltage to the tunable dielectric layer alters a dielectric constant of the tunable dielectric layer.

19. The operating method of a switchable radiator of claim 16, wherein the inductive loading and the capacitive loading form a radiating structure, the operating method comprises applying a first DC voltage to the tunable dielectric layer so as to disable the switchable radiator from radiating energy through the radiating structure and applying a second DC voltage to the tunable dielectric layer so as to enable the switchable radiator to radiate energy through the radiating structure.

* * * * *